US010881164B2

(12) United States Patent
Zampieri et al.

(10) Patent No.: US 10,881,164 B2
(45) Date of Patent: Jan. 5, 2021

(54) SKI BOOT, IN PARTICULAR BOOT FOR SKI TOURING

(71) Applicant: Tecnica Group S.p.A., Giavera del Montello (IT)

(72) Inventors: Claudio Zampieri, Giavera del Montello (IT); Alfio Mogno, Giavera del Montello (IT); Giovanni Girolimetto, Giavera del Montello (IT); Marco Breda, Giavera del Montello (IT)

(73) Assignee: TECNICA GROUP S.P.A., Giavera del Montello (IT)

( * ) Notice: Subject to any disclaimer, the term of this patent is extended or adjusted under 35 U.S.C. 154(b) by 0 days.

(21) Appl. No.: 16/138,035

(22) Filed: Sep. 21, 2018

(65) Prior Publication Data

US 2019/0082778 A1 Mar. 21, 2019

(30) Foreign Application Priority Data

Sep. 21, 2017 (IT) ..... 102017000105722

(51) Int. Cl.
*A43B 5/04* (2006.01)

(52) U.S. Cl.
CPC ..... *A43B 5/0474* (2013.01); *A43B 5/0411* (2013.01); *A43B 5/0447* (2013.01); *A43B 5/0456* (2013.01); *A43B 5/0496* (2013.01)

(58) Field of Classification Search
CPC ..... A43B 5/0411; A43B 5/047; A43B 5/0474; A43B 5/0447; A43B 5/0456; A43B 5/0496; A43B 5/0492; A43B 5/0468; A43B 5/04; A43B 5/0419; A43B 5/0429; A43B 5/0431; A43B 5/0435; A43B 5/0439; A43B 5/0449; A44B 11/12; A44B 11/14; A43C 11/14; A43C 11/1406
USPC ..... 36/117.2, 117.8, 118.1, 118.7, 118.9
See application file for complete search history.

(56) References Cited

U.S. PATENT DOCUMENTS

| | | | | |
|---|---|---|---|---|
| 4,253,217 | A * | 3/1981 | Marzocchi | A43C 11/1413 24/69 SK |
| 4,928,407 | A | 5/1990 | Ottieri | |
| 4,949,479 | A | 8/1990 | Ottieri | |
| 4,955,149 | A | 9/1990 | Ottieri | |
| 4,969,278 | A | 11/1990 | Ottieri | |
| 6,347,436 | B1 * | 2/2002 | Barber | A43C 1/00 24/68 SK |

(Continued)

FOREIGN PATENT DOCUMENTS

| | | | |
|---|---|---|---|
| EP | 2898788 | A1 | 7/2015 |
| WO | 90/05466 | A1 | 5/1990 |

OTHER PUBLICATIONS

Italian Search Report and Written Opinion issued for Italian Patent Application No. 102017000105722 dated May 9, 2018.

*Primary Examiner* — Jameson D Collier
(74) *Attorney, Agent, or Firm* — Howson & Howson LLP

(57) ABSTRACT

A ski boot is provided of the type including a substantially soft inner liner, a substantially rigid outer shell and a cuff articulated to the shell, and further including a spoiler articulated to the shell and arranged between the inner liner and the cuff. The ski boot includes a locking device for selectively allowing or preventing rotation of the cuff relative to the shell and, at the same time, for selectively allowing or preventing the movements of the spoiler relative to the cuff, and consequently also relative to the shell.

9 Claims, 2 Drawing Sheets

(56) References Cited

U.S. PATENT DOCUMENTS

| | | | | |
|---|---|---|---|---|
| 8,065,820 | B2 * | 11/2011 | Sartor | A43C 11/142 36/117.1 |
| 9,320,314 | B2 | 4/2016 | Zampieri et al. | |
| 9,549,592 | B2 | 1/2017 | Quagliotto et al. | |
| 9,743,708 | B2 | 8/2017 | Chaigne | |
| 10,045,582 | B2 | 8/2018 | Grandin et al. | |
| 2002/0029497 | A1 * | 3/2002 | Pierce | A43B 5/0456 36/118.3 |
| 2008/0189922 | A1 * | 8/2008 | Marechal | A43C 11/1433 24/68 SK |
| 2014/0013629 | A1 * | 1/2014 | Haugen | A43B 5/0456 36/117.1 |
| 2015/0033586 | A1 * | 2/2015 | Parisotto | A43B 5/0456 36/117.1 |
| 2016/0235165 | A1 | 8/2016 | Grandin | |
| 2016/0255906 | A1 | 9/2016 | Grandin et al. | |
| 2016/0279889 | A1 | 9/2016 | Grandin et al. | |
| 2016/0302514 | A1 | 10/2016 | Martinazzo et al. | |
| 2017/0105488 | A1 | 4/2017 | Grandin et al. | |
| 2017/0297286 | A1 | 10/2017 | Grandin et al. | |

* cited by examiner

SKI BOOT, IN PARTICULAR BOOT FOR SKI TOURING

BACKGROUND

The present invention relates to a ski boot, of the type comprising a substantially rigid outer shell and a cuff articulated to said shell. More particularly, the present invention refers to a ski boot comprising a locking device, designed to lock or unlock the shell and the cuff articulated thereto relative to each other. The present invention finds application, in particular but not exclusively, in the field of ski touring boots.

According to prior art, ski boots usually comprise an inner liner made of a substantially soft material and an outer shell made of a substantially rigid material. Still according to prior art, a cuff, which is adapted to receive the user's ankle and the lower part of the user's calf, is coupled to the substantially rigid shell of the ski boot, which is adapted to receive the user's foot.

In general, said cuff is articulated to the shell at the area of the malleoli, so as to allow—if desired—a rotation of the cuff with respect to the shell. This possibility is particularly important in the case of ski touring boots: when the user has to walk while going up a slope, it is obviously preferable that the cuff is free to rotate relative to the shell, so as to make walking more comfortable; on the other hand, when the user goes down the slope skiing, it is preferable that the cuff is locked relative to the shell, both for safety reasons and for obtaining satisfactory performance, by guaranteeing that movements—even minimal—of the user's leg are rigidly transmitted to the ski boot, and from the boot to the ski.

Devices are known from the state of the art which allow to switch from a first configuration, in which the cuff can rotate relative to the shell (configuration suitable for walking), to a second configuration, in which rotation of the cuff relative to the shell is locked (configuration suitable for skiing), and vice versa. Said locking devices generally comprise a male element connected to the cuff and a female element connected to the shell, or vice versa, in which at least one of said elements is movable. In this way, the movable element can be brought, for example by means of a rotational or translational movement, into engagement with the other element or be disengaged from it: when the male and female elements are engaged with each other, the rotation between the shell and cuff is prevented, whereas when the male and female elements are disengaged from each other, the cuff is free to rotate relative to the shell.

A driving member is usually provided for driving the rotational or translational movement of the movable element for switching the ski boot from one configuration to the other one.

In addition to the shell and the cuff, many known ski boots (and namely many known boots for ski touring) comprise a third element, a so-called "spoiler", which is connected to the rear wall of the shell and is arranged between the inner liner and the cuff. The spoiler essentially has two functions: firstly, it allows to adapt the ski boot to the specific morphological conformation of the user's calf; secondly, it allows to provide a greater forward inclination during skiing, if desired.

It is evident that, if the spoiler were fixedly connected to the shell, it would be of hindrance to the user when going up a slope by walking; for this reason, it is usually articulated to the rear wall of the shell. However, it is also evident that, in order to achieve the aforementioned functions, the spoiler should maintain a fixed position relative to the shell when the user is skiing.

Even though during skiing the cuff is blocked relative to the shell and this entails limitations to the possibility of movement of the spoiler, a certain mobility of the spoiler relative to the shell still remains, which mobility may result in a poor comfort for the user while skiing, thus making useless the presence of said spoiler. Therefore, the problem arises of eliminating the possibility of unwanted movements of the spoiler relative to the shell when the ski boot is used during skiing (i.e. when going down a slope).

Document EP 2 116 145 discloses a ski touring boot that includes an inner liner made of a soft material, an outer shell made of a rigid material, a cuff articulated to the shell and a spoiler articulated to the shell and interposed between the inner liner and the cuff; the cuff is provided at one of its edges with a driving lever for driving a tie rod suitable for engaging with a retaining element provided on the other edge of said cuff, and said driving lever is provided with a hooking element which, when the lever is in a closing configuration, can simultaneously engage the cuff and the spoiler, thereby blocking the articulation therebetween.

The solution suggested by EP 2 116 145 has several drawbacks.

Firstly, a boot made according to the teachings of EP 2 116 145 lacks any locking elements which directly act onto the shell and onto the cuff for preventing mutual rotation thereof; on the contrary, articulation of the cuff relative to the shell is prevented—when the lever is in the closing configuration—only indirectly, through the spoiler. This makes the locking of the cuff relative to the shell not so tight and has a significant negative effect on the performance of the ski boot during skiing.

Moreover, according to the disclosure of EP 2 116 145, the locking of the articulation does not occur automatically as soon as the lever is brought to the closing configuration, but it only occurs after the movements of the user's foot and the oscillations to which the boot is subjected have brought the hooking element into the correct position relative to the cuff and the spoiler. As a result, the solution suggested by EP 2 116 145 is scarcely reliable.

The object of the present invention is to overcome the drawbacks of prior art, by providing a ski boot provided with an improved locking device capable of effectively locking the cuff and the spoiler of the ski boot relative to the boot shell. This and other objects are achieved by the ski boot as claimed in the appended claims.

SUMMARY

The ski boot according to the invention comprises, in a manner known per se, an inner liner made of a substantially soft material, an outer shell made of a substantially rigid material, a cuff articulated to the rigid outer shell and a spoiler articulated to the rear portion of the shell and arranged between the inner liner and the cuff.

The ski boot according to the invention further comprises a locking device for selectively allowing or preventing movement of said cuff and said spoiler relative to said shell. Said locking device comprises a first engaging element integral with the shell or connected thereto, and a second engaging element integral with the cuff or connected thereto, which are configured to cooperate with each other for locking said shell and said cuff relative to each other. Said locking device comprises a driving element which is switchable from a first position, in which said first and said second engaging elements are in a first configuration in which they are disengaged from each other, to a second position, in which said first and said second engaging elements are in a second configuration in which they are engaged with each other, and vice versa.

According to the invention, the locking device further comprises a third engaging element integral with the cuff or connected thereto, and a fourth engaging element integral with the spoiler or connected thereto, which are configured to cooperate with each other to lock said cuff and said spoiler relative to each other, and said driving element, when it is switched to said first position, brings said third and said fourth engaging elements to a first configuration in which they are disengaged from each other, and, when it is switched to said second position, it brings said third and said fourth engaging elements to a second configuration in which they are engaged with each other.

Thanks to the structure of the locking device of the ski boot according to the invention, when the driving element is in the second position, any movement between the shell and the cuff is prevented by the mutual cooperation of the first and second engaging elements; moreover, with the driving element in said second position, any movement between the cuff and the spoiler is prevented by the mutual cooperation of the third and fourth engaging elements, which means that the spoiler is also fixed relative to the shell when the driving element is in said second position.

In a preferred embodiment of the invention, the first engaging element is a male element, such as for example a bar, and the second engaging element is a female element, such as for example a seat for said bar, and the driving element is switchable from a first position, in which said first male element and said second female element are disengaged from each other, to a second position, in which said first male element is inserted in said second female element, thus blocking any relative movement between the shell and the cuff of the ski boot.

It is evident that, in an alternative embodiment of the invention, the first engaging element could be a female element and the second engaging element could be a male element.

In a preferred embodiment of the invention, the third engaging element is a male element, such as for example a tooth, and the fourth engaging element is a female element, such as for example a hole for said tooth, and the driving element is switchable from a first position, in which said third male element and said fourth female element are disengaged from each other, to a second position, in which said third male element is inserted in said fourth female element, thus blocking any relative movement between the spoiler and the cuff and then, ultimately, between the spoiler and the shell.

It is evident that, in an alternative embodiment of the invention, the third engaging element could be a female element and the fourth engaging element could be a male element.

In a preferred embodiment of the present invention, the driving member is a driving lever, which is rotatably connected to the cuff at a first end and, at the second opposite end, carries the second engaging element. In this preferred embodiment of the present invention, the driving lever is switchable from the first to the second position by overcoming the elastic resistance of a spring, the first end of which is connected to said driving lever; the opposite end of the spring is not connected to the cuff, but it is connected to a driven element which, at a first end, is also rotatably connected to the cuff and, at the second opposite end, carries the third engaging element. When the driving lever switches from the first to the second position by overcoming the elastic resistance of the spring, the spring exerts a traction onto the driven element to which it is connected, thus causing said driven element to rotate relative to the cuff and to move to a position in which the third engaging element provided on said driven element engages the fourth engaging element provided on the spoiler.

BRIEF DESCRIPTION OF THE DRAWINGS

Further features and advantages of the invention will become more evident from the following detailed description of a preferred embodiment, given by way of non-limiting example, with reference to the attached drawings, in which.

DETAILED DESCRIPTION

The preferred embodiment of the invention described below refers to the application of the invention to a boot for ski touring. However, this embodiment must not be understood in any way as limiting the scope of the invention.

Figure 1:
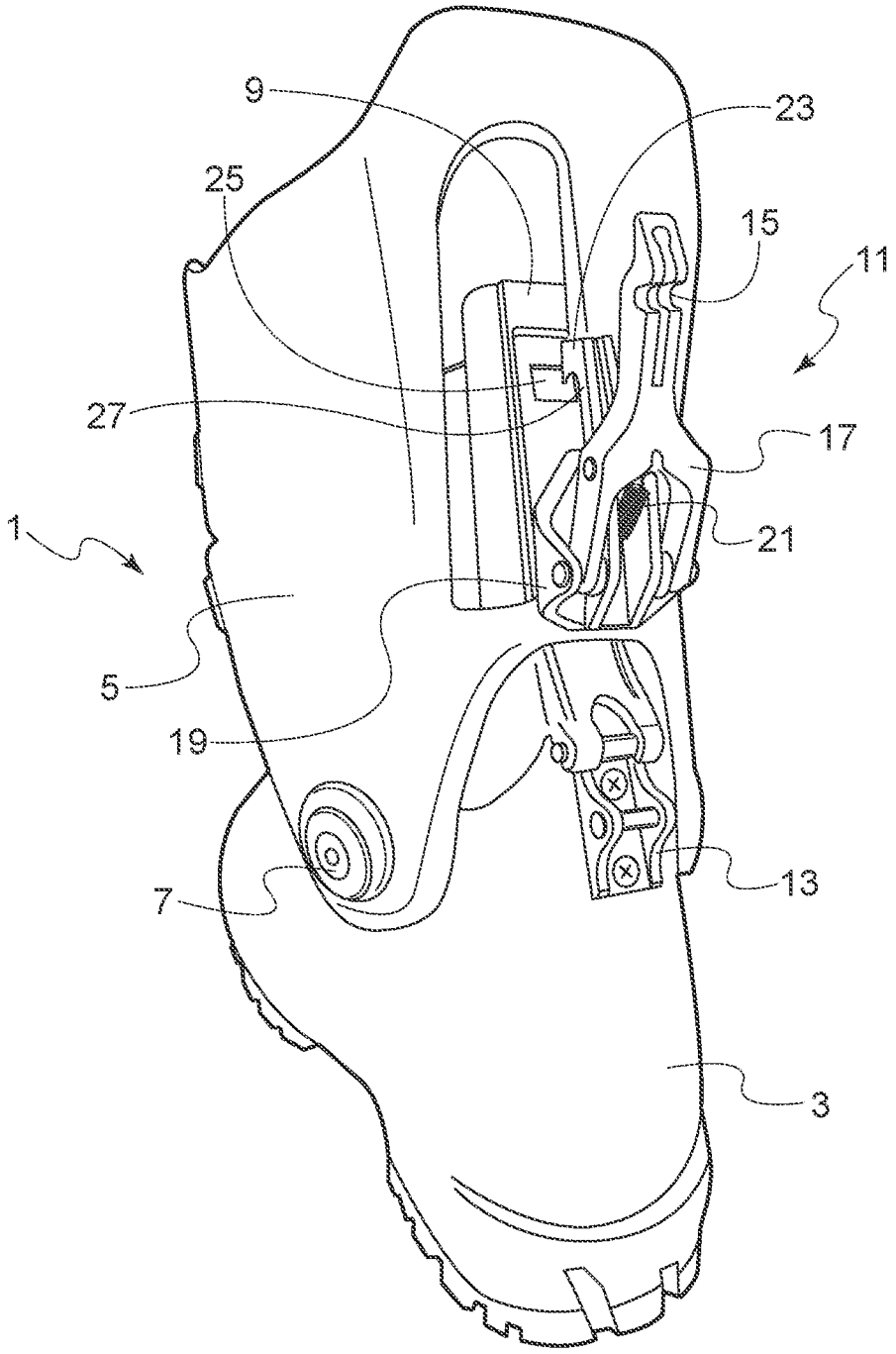
FIG. 1 is a perspective view from behind of a ski boot according to a preferred embodiment of the invention, shown in a first configuration or walking configuration.
Figure 2:
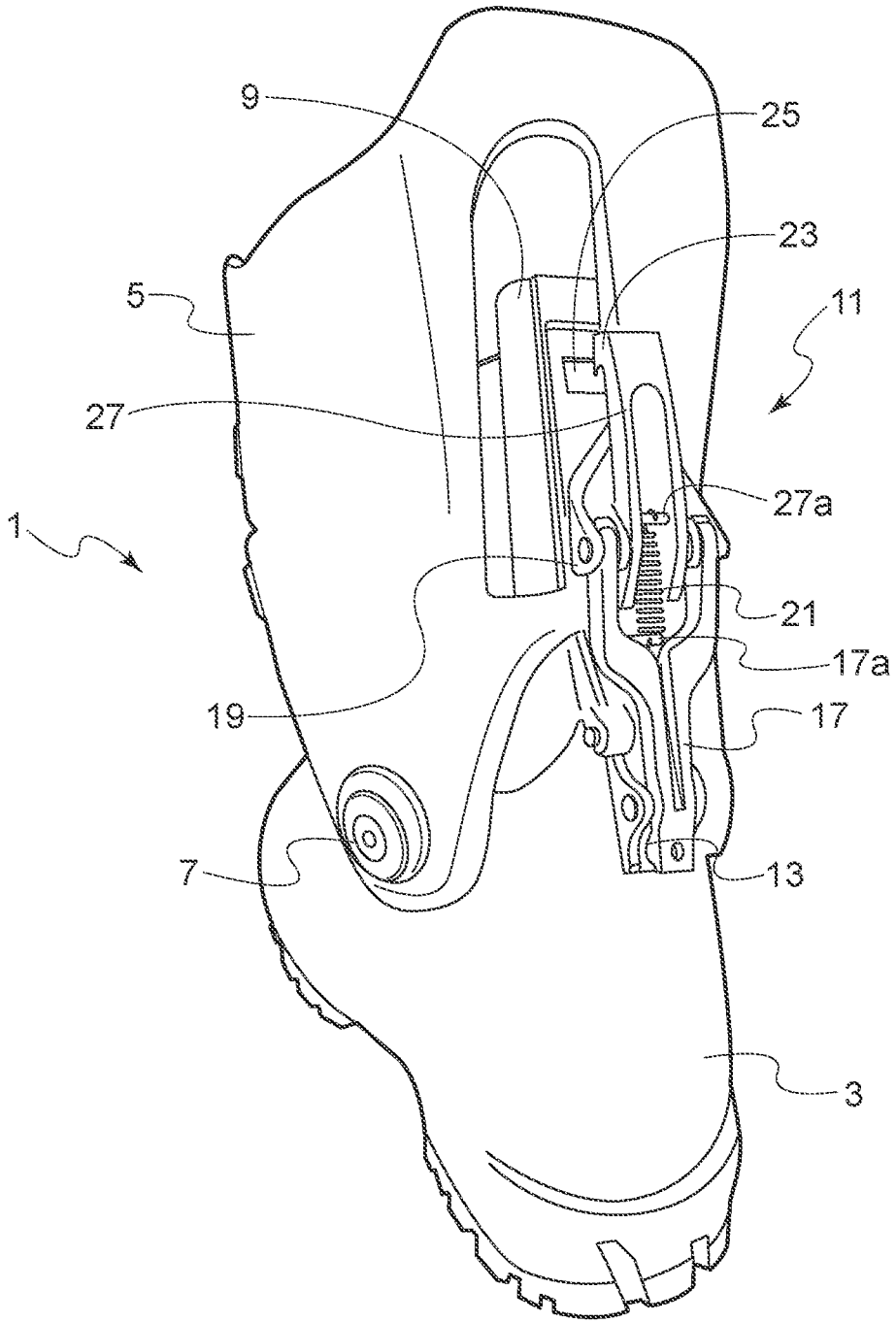
FIG. 2 is a perspective view from behind of the ski boot of FIG. 1, shown in a second configuration or skiing configuration.

With reference to FIGS. 1 and 2, a ski boot 1 according to the invention is schematically shown. In a manner known per se, the ski boot 1 comprises an inner element or inner liner made of a substantially soft material (not shown in the Figures for the sake of clarity) and an outer element or outer shell 3 made of a substantially rigid material. The outer shell 3 is shaped to accommodate the user's foot and the ski boot 1 also comprises a cuff 5, which is also made of a substantially rigid material and is articulated to the outer shell 3 by means of rotation pins 7 (only one of which can be seen in the Figures) on the two opposite sides of said outer shell 3, substantially at the area of the malleoli.

The ski boot 1 further comprises a spoiler 9, which is also made of a substantially rigid material and is articulated to the outer shell 3 by means of a pivot pin 11 at the rear side of said shell, so that said spoiler 9 is arranged between the inner liner and the rear wall of the cuff 5. In this respect, it is to be noted that in the Figures a portion of the cuff has been removed in order to make the spoiler 9 behind it visible.

The ski boot 1 further comprises a locking device 11 for selectively allowing or preventing rotation of the cuff 5 relative to the shell 3. Said locking device 11 comprises a first engaging element 13, which is integral with the shell or connected thereto. In the shown embodiment, said engaging element is a male engaging element, more particularly a transverse bar 13 fixed to the shell 3.

Correspondingly, the locking device comprises a second engaging element 15, which is integral with the cuff or connected thereto and which is configured to cooperate with the first engaging element 13. It is evident that, in the shown embodiment, the second engaging element has to be a female engaging element, and specifically it is a seat 15 configured to receive and retain the bar 13.

The locking device 11 comprises a driving element 17 which is switchable from a first position, in which said first and second engaging elements 13, 15 are in a first configuration in which they are disengaged from each other, to a second position, in which said first and second engaging elements 13, 15 are in a second configuration in which they are engaged with each other, and vice versa.

More particularly, in the embodiment shown in the Figures, said driving element is a driving lever 17 which, at a first end, is rotatably connected to a base plate 19 fixed to the cuff 5 and, at the second opposite end, carries the seat 15: in the first position of the driving lever 17 (FIG. 1), said first and second engaging elements 13, 15 are disengaged from each other and the cuff 5 is free to rotate relative to the shell 3; in the second position of the driving lever 17 (FIG. 2), said first and second engaging elements 13, 15 are engaged with each other (i.e., the rod 13 is inserted in the seat 15) and the rotation of the cuff 5 relative to the shell 3 is prevented.

In order to switch from the first to the second position, the driving lever 17 must overcome the elastic resistance of a spring 21, which is configured to stably keep said driving lever in said first position. After the driving lever has been brought to the second position, the engagement between said first and second engaging elements 13, 15 stably maintains said driving lever in said position. In order to bring the driving lever back to the first position, the user must manually disengage the first and second engaging elements 13, 15, and then the spring 21, while returning to its rest configuration, will bring said driving lever 17 to said first position.

Advantageously, thanks to the mutual engagement of the first and second engaging elements 13, 15, the locking device 11 of the ski boot according to the invention provides for a direct locking between the shell 3 and the cuff 5, which guarantees that the relative rotation of said cuff and said shell is effectively prevented when said first and second engaging elements are in the second configuration.

According to the invention, the locking device 11 further comprises a third engaging element 23, integral with the cuff or connected thereto, and a fourth engaging element 25, integral with the spoiler or connected thereto, which engaging elements are configured to cooperate with each other to lock said cuff and said spoiler relative to each other, and the locking device 11 is configured so that, when the driving lever 17 is in said first position, said third and fourth engaging elements 23, 25 are in a first configuration in which they are disengaged from each other and, when said driving lever is switched to said second position, it brings said third and fourth engaging elements 23, 25 to a second configuration, in which they are engaged with each other and in which the movements of the spoiler 9 relative to the cuff 5 are prevented.

In the shown embodiment, the locking device 11 comprises a driven element 27, which can be driven by the driving lever 17 and which is made as an arm which, at a first end, is articulated to the base plate 19 and, at the second end, carries the third engaging element 23.

In the shown embodiment, said third engaging element is a male engaging element, more particularly a tooth 23 formed at said second end of the driven element 27. Correspondingly, in the shown embodiment the fourth engaging element has to be a female engaging element and specifically it is a through-hole 25 formed in the spoiler 9 and adapted to receive the tooth 23.

In this respect, it is to be noted that, during skiing, the relative rotation between the spoiler and the cuff is prevented per se by the fact that the spoiler is interposed between the inner liner of the ski boot and the cuff (which is locked relative to the shell during skiing). Accordingly, the third and fourth engaging elements 23, 25 must be shaped to prevent undesired translational movements of the spoiler relative to the cuff and/or to the shell rather than to prevent a relative rotation between the cuff and the spoiler.

The locking device 11 is configured so that when the driving lever 17 switches from said first position to said second position, it simultaneously controls the movement of the driven element 27 from a first position, in which said third and fourth engaging elements 23, 25 are in the first configuration in which they are disengaged from each other, to a second position, in which said driving lever brings said third and fourth engaging elements 23, 25 to the second configuration in which they are engaged with each other.

More particularly, in the shown embodiment, the spring 21 has a first end connected to a cross member 17*a* of the driving lever 17, which cross member is arranged at a certain distance from the end of said driving lever rotatably connected to the base plate 19, and a second opposite end connected to the driven element 27, namely onto a cross member 27*a* of the driven element 27, which cross member is arranged at a certain distance from the end of said driven element rotatably connected to the base plate 19. When the driving lever 17 switches from the first to the second position by overcoming the elastic resistance of the spring 21, the spring exerts a traction on the cross member 27*a* of the driven element 27 to which it is connected, thus causing said driven element 27 to rotate relative to the base plate 19 connected to the cuff 5, so as to bring the third and fourth engaging elements 23, 25 to the engaged configuration (in particular, in the shown embodiment, so as to cause the tooth 23 to penetrate into the through-hole 25 of the spoiler).

In brief, thanks to the structure of the locking device 11 of the ski boot 1 according to the invention, when the driving lever 17 is in the first position, the cuff 5 and the spoiler 9 can freely rotate relative to the shell 3; on the other hand, when the driving lever 17 is brought to the second position, the rotation of the cuff 5 relative to the shell 3 is prevented and, at the same time, the movements of the spoiler 9 relative to the cuff 5 are also prevented, so that the relative positions of the shell, the cuff and the spoiler are fixed.

It is therefore evident that, when the user wishes to walk (for example when going up a slope when practicing ski touring), he/she will keep the driving lever 17 of the locking device 11 in the first position, while he/she will bring said driving lever to the second position before going down the slope.

It is therefore evident from the foregoing that the invention achieves the aforementioned objects, as it provides a ski boot provided with a locking device which overcomes the drawbacks of prior art.

It is also evident that the embodiment described above in detail must in no way be understood in a limiting sense and that several variations and modifications within the reach of the person skilled in the art are possible without departing from the scope of the invention, as defined by the appended claims. In particular, the number, the nature, the structure and the operation of the engaging elements and of the components of said engaging elements may be chosen each time by the person skilled in the art according to his/her knowledge and preferences, without thereby departing from the scope of the invention, as defined by the appended claims.

We claim:

1. A ski boot comprising: an outer shell and a cuff, which is pivotally connected to the outer shell, and further comprising a spoiler, which is pivotally connected to the outer shell and extends interiorly within the cuff, wherein the ski boot further comprises a locking device, wherein the locking device comprises:

a first engaging element, which is integral with or connected to the outer shell, and a second engaging element, which is integral with or connected to said cuff and which is designed for cooperating with the first engaging element, a third engaging element, which is integral with or connected to the cuff, and a fourth engaging element, which is integral with or connected to the spoiler and which is designed for cooperating with the third engaging element, a driving element connected to the cuff and switchable between a first position, in which the locking device is in a configuration in which the outer shell and the cuff are disengaged from each other and the cuff and the spoiler are disengaged from each other, and a second position, in which the locking device is in a configuration in which the outer shell and the cuff are engaged with each other and the cuff and the spoiler are engaged with each other, wherein when the driving element is in the first position, the first and second engaging elements are in a first configuration in which they are disengaged from each other and the third and fourth engaging elements are in a first configuration in which they are disengaged from each other, and when the driving element is in the second position, the first and second engaging elements are in a second configuration in which they are engaged with each other and the third and fourth engaging elements are in a second configuration in which they are engaged with each other.

2. The ski boot of claim 1, wherein the locking device comprises a driven element, which is connected to the cuff and carries the third engaging element, the driven element being movable between a first position, in which the third and fourth engaging elements are in the first configuration in which they are disengaged from each other, and a second position, in which the third and fourth engaging elements are in the second configuration in which they are engaged with each other, and wherein when the driving element switches from the driving element's first position to the driving element's second position, the driving element drives the switching of the driven element from the driven element's first position to the driven element's second position, and vice versa.

3. The ski boot of claim 2, further comprising a spring element, wherein the driving element is a driving lever with two ends, wherein the driving lever is pivotally connected, at a first one of the two ends, to the cuff and carries, at a second, opposite one of the two ends, the second engaging element, wherein the driving lever is in said first position when the driving element is at rest, and wherein the driving element is switchable to the second position against the resistance of the spring element.

4. The ski boot of claim 3, wherein the spring element is a spring, and wherein a first end of the spring is connected to the driving lever and a second, opposite end of the spring is connected to the driven element.

5. The ski boot of claim 1, further comprising a spring element, wherein the driving element is in the first position when the driving element is at rest, and wherein the driving element is switchable to the second position against the resistance of the spring element.

6. The ski boot of claim 1, wherein the first engaging element is a male engaging element, and the second engaging element correspondingly is a female engaging element.

7. The ski boot of claim 6, wherein the first engaging element is a transverse bar fixed to the outer shell and the second engaging element is a seat configured to receive and retain the transverse bar.

8. The ski boot of claim 1, wherein the third engaging element is a male engaging element, and the fourth engaging element correspondingly is a female engaging element.

9. The ski boot of claim 8, wherein the third engaging element is a tooth and the fourth engaging element is a through-hole adapted to receive the tooth.

* * * * *